US007093363B1

(12) United States Patent
Kuo

(10) Patent No.: US 7,093,363 B1
(45) Date of Patent: Aug. 22, 2006

(54) FOLDABLE RAZOR ASSEMBLY

(76) Inventor: Jack C. Kuo, P.O. Box 24-108, Taipei (TW)

( * ) Notice: Subject to any disclaimer, the term of this patent is extended or adjusted under 35 U.S.C. 154(b) by 0 days.

(21) Appl. No.: 11/178,801

(22) Filed: Jul. 12, 2005

(51) Int. Cl.
*B26B 21/52* (2006.01)

(52) U.S. Cl. ..... 30/47; 30/32; 30/535; 30/541

(58) Field of Classification Search ..... 30/47, 30/50, 527, 532, 530, 533, 32, 535, 541; 28/45, 48; 206/228
See application file for complete search history.

(56) References Cited

U.S. PATENT DOCUMENTS 1,381,724 A * 6/1921 Maloney ..... 132/291
2,017,741 A * 10/1935 Wallenthin ..... 30/534
2,133,576 A * 10/1938 Rud ..... 30/47
2,294,284 A * 8/1942 Chu ..... 30/47
2,553,660 A * 5/1951 Levendusky ..... 254/28
3,492,722 A * 2/1970 Sieve ..... 30/47
4,332,321 A * 6/1982 Wratschko ..... 206/228
5,010,645 A * 4/1991 Furukawa ..... 30/47
5,206,994 A * 5/1993 Lin ..... 30/47
5,465,488 A * 11/1995 Yaw et al. ..... 30/41
5,784,785 A * 7/1998 Polites ..... 30/53
6,381,857 B1 * 5/2002 Oldroyd ..... 30/527

* cited by examiner

*Primary Examiner*—Hwei-Siu Payer
(74) *Attorney, Agent, or Firm*—Troxell Law Office, PLLC

(57) ABSTRACT

A foldable razor assembly includes a detachable razor blade embedded at the front end of a handle, a box base with its lateral side pivotally coupled to the rear end of the handle, a cavity defined by the box base and a lid for containing the handle and razor blade, and a box body. Since the handle is pivotally coupled to an end of the box base, the handle can be rotated directly to put the handle and the razor blade into the cavity of the box base, and the lid is turned to cover the cavity when the razor is not in use, so as to reduce the overall storage volume of the razor for an easy storage or carry. The invention can prevent the box body from being separated from the razor or missing, and also can keep the razor from being contaminated by the environment. When it is necessary to use the razor, the lid is opened and the handle is turned to combine with the box body. The invention can be folded or unfolded for easy storage or use.

3 Claims, 2 Drawing Sheets

FOLDABLE RAZOR ASSEMBLY

BACKGROUND OF THE INVENTION

1. Field of the Invention

The present invention relates to a foldable razor assembly, and more particularly to a foldable razor assembly that overcomes the shortcomings of a prior art razor of occupying a relatively large volume and being not easy or inconvenient to carry and store, missing the box for containing the razor easily, and being contaminated by the environment. A foldable razor assembly according to the invention includes a detachable razor blade embedded into the front end of a handle, a box base with its lateral side pivotally coupled to the rear end of the handle, a cavity defined by the box base and a lid for containing the handle and razor blade, and a box body. Since the handle is pivotally coupled to an end of the box base, the handle can be turned directly to put the handle and the razor blade into the cavity of the box base, and the lid is turned to cover the cavity when the razor is not in use, so as to reduce the overall storage volume of the razor for an easy storage or carry. The invention can prevent the box body from being separated from the razor or missing, and also can protect the razor from being contaminated by the environment. When it is necessary to use the razor, the lid is opened and the handle is turned to integrate with the box body. The invention can be folded or unfolded for easy storage or use.

2. Description of the Related Art

The present razors sold in the market are generally in a T-shape, which usually include a handle and a blade disposed vertical to the handle and installed at the top of the handle. To prevent the razor from being contaminated by the environment, a box or housing is provided for containing the razor. However, the length of razors of this sort is relatively long and its volume is relatively large, and thus it is inconvenient for users to carry or store the razor. Furthermore, the razor is separated from the box or housing, when the razor is in use, and users may lose the box easily and the razor may be contaminated. Therefore, improvements are needed for the prior art razors.

SUMMARY OF THE INVENTION

In view of the shortcomings of the prior arts, the inventor of the present invention based on years of experience on razors to conduct extensive researches and experiments to overcome the foregoing shortcomings and seek feasible solutions for improvements and finally invented a foldable razor assembly.

The primary objective of the present invention is to provide a foldable razor assembly that includes a detachable razor blade embedded into the front end of a handle, a box base with its lateral side pivotally coupled to the rear end of the handle, a cavity defined by the box base and a lid for containing the handle and razor blade, and a box body. Since the handle is pivotally coupled to an end of the box base, the razor blade, handle and box body can be extended as a whole body when the razor is used, or the handle can be rotated directly to put the handle and the razor blade into the cavity of the box base, and the lid is turned to cover the cavity when the razor is not in use, so as to reduce the overall storage volume of the razor for an easy storage or carry.

The secondary objective of the present invention is to provide a foldable razor assembly including a razor blade, a handle, and a box body that can be extended into a whole body to prevent the loss of the box body and protect the razor from being contaminated by the environment. When the razor is in use, a user just needs to open the box and turns out the handle to be extended together with the box body as a whole body for a quick and convenient storage.

DETAILED DESCRIPTION OF THE PREFERRED EMBODIMENTS

Figure 1:
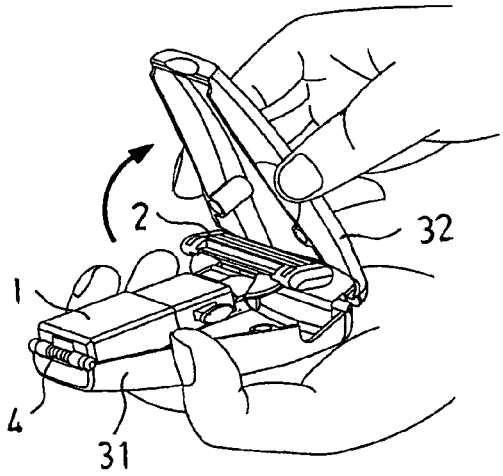
FIG. 1 is a schematic perspective view of a stored razor according to a preferred embodiment of the present invention.

To make it easier for our examiner to understand the structure and performance of the present invention, the following detailed description with reference to the accompanying drawings of an embodiment are given for example, but such preferred embodiment is not intended to limit the scope of the present invention.

Referring to the figures, the foldable razor assembly comprises a razor blade 2, a handle 1, and a box body 3; wherein the length of the handle 1 is slightly shorter than the handle of the traditional razors (about half of the length), a latch groove (not shown in the figure) is disposed at a lateral surface of the front end of the handle 1 for embedding a detachable razor blade 2, and a box base 31 of the box body 3 is pivotally connected to the rear end of the handle 1 by a spring 4, and the box body 3 is a hollow box defined by the box base 31 and the box cover 32 covering the box base 31. A cavity 30 at the interior of the box body 3 is provided for turning the handle 1 and razor blade 2 therein, and a magnetic member 34, 35 or a latch member is disposed separately on the box base 31 and the box cover 32 for fixing the cover of the box body 1.

Figure 3:
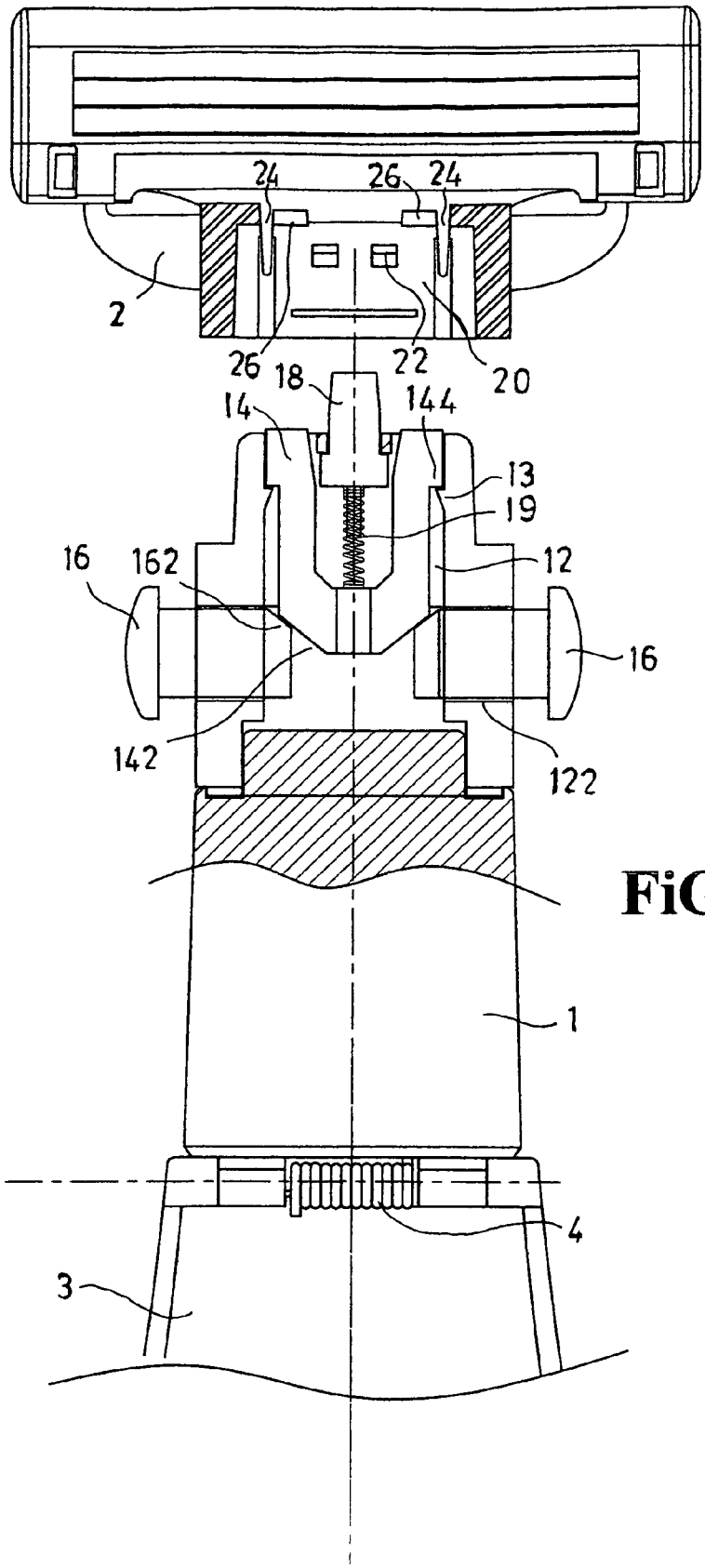
FIG. 3 is a cross-sectional side view of a handle and a razor blade according to a preferred embodiment of the present invention.

Referring to FIG. 3 for the connection of the handle 1 and the razor blade 2, a accommodating groove 12 having an opening at its top is disposed at the top of the handle 1; an inverted hook 13 is installed on both sides of the opening of the accommodating groove 12; a U-shape pushing member 14 is installed in the accommodating groove 12, and the top of the pushing member 14 is protruded from the opening of the accommodating groove 12, and the bottom of the pushing member 14 has an aslant surface, and both sides of the top of the pushing member 14 has a protruded member 144 for stopping the inverted hook 13 on both sides of the accommodating groove 12. A transversal through hole 122 is disposed separately on both sides of the accommodating groove 12 of the handle 1, and a press button is disposed in the through hole 122, and the internal side of an end of the press button 16 has an aslant surface 162 in contact with the aslant surface 142 at the bottom of the pushing member 14. A blocking member 18 is disposed in the accommodating groove 12 at the top of the pushing member 14 and its front end is restricted by a protruded member 144 from being protruded from the accommodating groove 12. A compressed spring 19 is installed between the blocking member 18 and the pushing member 14, and the resilience of the compressed spring 19 presses at a position between the blocking member 18 and the pushing member 14. Since the protruded member 144 at the front end of the pushing member 14 is stopped by the inverted hook 13 at a side of the accommodating groove 12, the pushing member 14 will not be pushed by the compressed spring 19 all the way to the bottom of the accommodating groove 12. In the meantime, the compressed spring 19 applies a tension to the blocking member 18, such that when the razor is in use, the front end of the blocking member 18 will elastically pushes the razor blade 2 under the action of the compressed spring 19, and the razor blade 2 can produce an appropriate elastic curve. The structure of the razor blade 2 of the invention is basically the same as the existing razor. Referring to FIG. 3 for a razor blade 2 of a Gillette Mach 3, a latch hole 20 is disposed at the bottom of the razor blade 2, and a latch member 22 is installed on the internal sidewall of the latch hole 20, such that when the front end section of the handle 1 is inserted into the latch hole 20, the latch member 22 is latched with the latch groove at the front end of the handle 1 to integrally connect the razor blade 2 and the handle 1. A groove crevice 24 is disposed on both sides of the sidewall of latch hole 20 and extended along the inserting direction of the handle 1, and the top end of the latch hole 20 includes a blocking plate 26. The front end of the pushing member 14 can be extended into the opening of the accommodating groove 12 to prop the bottom of the blocking plate 26.

Figure 2:
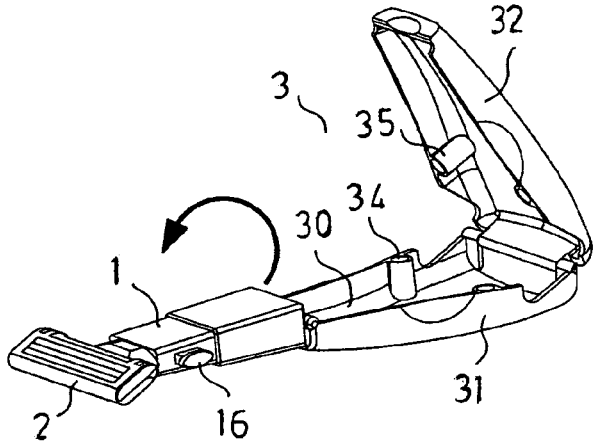
FIG. 2 is a cross-sectional side view of an unfolded razor according to a preferred embodiment of the present invention.

If it is necessary to use the razor, a user simply needs to open the box cover 32 as shown in FIGS. 1 and 2, the handle 1 will automatically turn and pop out under the action of the compressed spring 44, and then the box cover 32 will cover the box base 31 for the use of the razor. By that time, the box body 3 can be used as a part of the handle 1 to facilitate the shaving. After the use of razor, the box cover 32 is still opened. A user can turn the handle 1 together with the razor blade 2 into the box body 3 and then cover the box cover 32. Such arrangement can appropriate reduce the storage volume and facilitate the carrying and storage of the razor.

Figure 4:
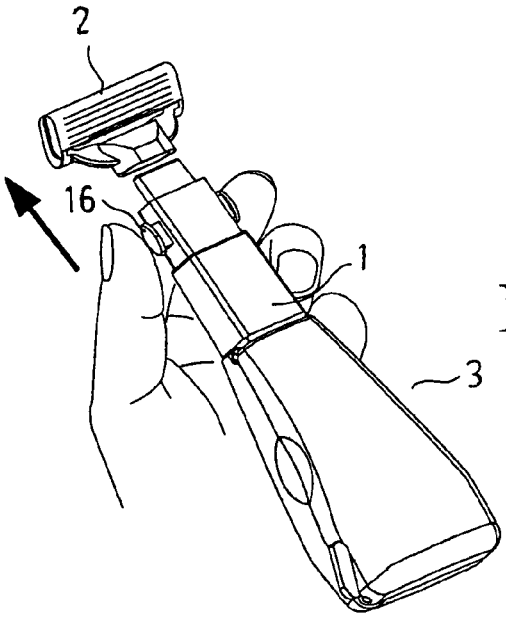
FIG. 4 is a schematic perspective view of removing a razor blade according to a preferred embodiment of the present invention.

Referring to FIG. 4, a user just needs to press the press button 16 on both sides of the front end of the handle 1 when it is necessary to replace the razor blade 2. The press button 16 pushes the pushing member 14 upward to push the blocking plate 26 inside the latch hole 20 of the razor blade 2, so that the sidewall connected with the blocking plate 26 produces an elastic curve. By that time, the latch member 22 is detached from the latch groove. Since the elastic curved sidewall tends to resume its original position, therefore a resilient force is applied to the front end of the handle 1 so as to eject the razor blade 2 from the top end of the handle 1.

In summation of the description above, the structure and device of the present invention are novel, not only appropriately reduce the storage volume of a razor to facilitate carrying and storing a razor, but also providing a way for preventing the box from being lost and the razor from being contaminated. The present invention has significant improved effect and also complies with the patent application requirements.

The description and its accompanied drawings are used for describing preferred embodiments of the present invention, and it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A foldable razor assembly, comprising a handle, a razor blade and a box body; wherein said box body is comprised of a box base having an accommodating cavity and a box cover, said box base being pivotally coupled with said box cover, and the top end of said handle having said razor blade detachably mounted thereon, and a lateral side of said box base of said box body being pivotally coupled with the bottom of said handle, and said handle and said razor blade being turned and accommodated by said cavity of said box body, said razor assembly further comprising: an accommodating groove disposed at an opening which is at the top of said handle; a U-shape pushing member disposed in said accommodating groove and having an opening at its top for being extended into the opening of said accommodating groove; an inverted hook installed separately on both sides of said opening of said accommodating groove; a protruded member disposed on both sides of the corresponding top end of said pushing member and stopped by said inverted hook; an aslant surface disposed separately on both sides at the bottom of said pushing member; a through hole disposed separately on both sides of the said accommodating groove; a press button installed in said through hole; an aslant surface disposed at an end of the internal side of said press button; such that said aslant surface of said press button being in contact with said aslant surface of said pushing member.

2. The foldable razor assembly of claim 1 wherein said pushing member further comprises a blocking member being disposed in said accommodating groove and restricted by a protruded member to extend its front end into said accommodating groove, and a compressed spring being installed between said blocking member and said pushing member.

3. A foldable razor assembly, comprising a handle, a razor blade and a box body; wherein said box body is comprised of a box base having an accommodating cavity and a box cover, said box base being pivotally coupled with said box cover, and the top end of said handle having said razor blade detachably mounted thereon, and a lateral side of said box base of said box body being pivotally coupled with the bottom of said handle, and said handle and said razor blade being turned and accommodated by said cavity of said box body, said razor assembly further comprising: a latch hole disposed at a side of the bottom of said razor blade; a latch member disposed on an internal sidewall inside said latch hole for latching a latch groove at the front end of said handle and integrated as a whole, and a blocking plate being disposed at a front curve of said sidewall and pressed by the front end of a pushing member.

* * * * *